US005939156A

United States Patent [19]

Rossi et al.

[11] Patent Number: 5,939,156

[45] Date of Patent: Aug. 17, 1999

[54] EASY TO OPEN PLASTIC CADDIE

[75] Inventors: Scott James Rossi; Douglas Edward Mosiman, both of Danville, Ill.

[73] Assignee: Teepak Investments, Inc., Wilmington, Del.

[21] Appl. No.: 08/886,834

[22] Filed: Jul. 1, 1997

[51] Int. Cl.[6] ..... A22C 13/00; B65B 53/02

[52] U.S. Cl. ..... 428/34.8; 428/43; 426/122; 426/123; 206/443; 206/802; 53/148; 53/415; 53/441; 53/444; 53/492

[58] Field of Search ..... 428/34.8, 43; 206/443, 206/499, 802, 824, 820; 53/441, 444, 492, 148, 415; 452/51; 426/122, 123

[56] References Cited

U.S. PATENT DOCUMENTS 4,396,039 8/1983 Klenk et al. ..... 428/34.8
5,356,007 10/1994 Feldt ..... 206/443
5,381,643 1/1995 Kazaitis et al. ..... 53/415
5,382,190 1/1995 Graves ..... 452/21
5,391,108 2/1995 Feldt ..... 452/21
5,577,366 11/1996 Higgins ..... 206/443
5,727,364 3/1998 Artieda ..... 53/415

*Primary Examiner*—Rena L. Dye
*Attorney, Agent, or Firm*—Michael L. Dunn

[57] ABSTRACT

A package comprising tubular food casing strands encased in a plastic film, said film encompassing said strands, said package being provided with a tear strip secured upon the outside surface of the film; weakened areas being provided in the film along parallel edges of said tear strip so that pulling of said strip away from the package causes film between the weakened areas to be removed with the strip thus opening the package and exposing the strands.

11 Claims, 1 Drawing Sheet

EASY TO OPEN PLASTIC CADDIE

BACKGROUND OF THE INVENTION

This invention relates to packages for food casing strands.

Food casing strands are shirred tubular film food casing. "Shirred" means radially folded so as to be compressed along the longitudinal axis of the tubular film.

Such shirred food casings are packages for storage and shipment to food processors, e.g. meat packers making cylindrically shaped sausage product.

Numerous types of packages for shirred food casing have been used in the prior art. Such packages have included rigid cartons as well as net and film wrappings.

Film wrappings have had certain advantages, e.g. they are light weight and usually provide a moisture barrier to prevent dehydration of moisturized strand products.

One difficulty with film packages for food casing strands has been that a film which is strong enough to provide a secure package is generally difficult to remove from the package product.

This problem has been addressed by providing adhesive opening strips or areas which can be readily removed to provide access to package contents.

Unfortunately such adhesive strips have caused yet another problem in that after removal they tend to stick to undesirable areas creating disorganization and a generally messy environment.

It is therefore an object of the invention to provide a readily openable film package for food casing strands which overcomes the disadvantages of prior art film packages.

BRIEF DESCRIPTION OF THE INVENTION

Figure 1:
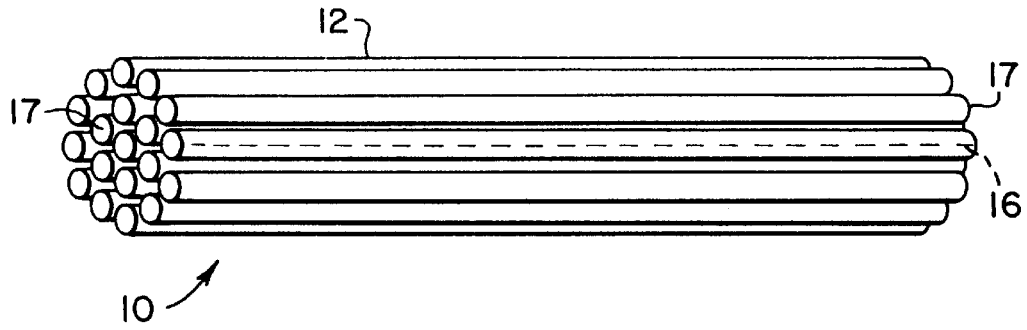
FIG. 1 shows a bundle of food casing strands to be packaged in accordance with the present invention.

The invention comprises a package comprising tubular food casing strands encased in a plastic film, said film encompassing said strands, said package being provided with a tear strip secured upon the outside surface of the film; weakened areas being provided in the film along parallel edges of said tear strip so that pulling of said strip away from the package causes film between the weakened areas to be removed with the strip thus opening the package and exposing the strands.

DETAILED DESCRIPTION OF THE INVENTION

The shirred tubular film to be packaged in accordance with the present invention may be of any suitable material, e.g., cellulose or collagen film and may be unreinforced or reinforced e.g., with fiber randomly dispersed or in the form of a woven or non-woven web.

The tubular film may be used to package any suitable food product, e.g., sausages such as hot dogs, bolognas, salamis, fresh sausage, lunch meats etc., whole meats such as hams or turkey breast or other food product such as cheeses.

The plastic film encompassing the strands may be any natural or synthetic plastic film, e.g., cellophane type film, polyethylene, polyvinylidine chloride, etc. The plastic film may have shrink wrap characteristics, e.g., the strands may be placed in a tubular plastic film and the film shrunk over the strands to provide secure containment. The film may also have stretch characteristics so that it can be stretched over the strands and then relaxed to secure the strands.

In accordance with a preferred embodiment of the invention, the film wrapping extends over the ends of the strands and is secured, e.g., clipped, glued, heat sealed or tied over the ends to provide a liquid tight package. The package ends are preferably heat sealed so that the sealed portion is in a plane which is essentially parallel to a plane defined by an edge of the sealed portion of the tear strip. When the tear strip and heat seal have such a relative orientation, it has been unexpectedly found that the strands are more easily freed from the package after removal of the tear strip.

It is however, to be understood that the quick opening feature of the invention may be used whether or not the package is sealed over the ends of the strands.

The tear strip is generally secured to the plastic film by a heat or catalyst activated adhesive and a weakened area, e.g. a thin film area or perforations, such as punctures or slits is provided along both edges of the tear strip. The tear strip may be of the same or different material than the film.

For ease in gripping the tear strip, at least one end thereof is desirably not attached to the film.

The tear strip may be at essentially any orientation on the film, e.g., radially or longitudinally or diagonally oriented. The strip is, however, usually oriented parallel to longitudinal axes of packaged strands and usually extends the entire length of the strands.

The invention may be better understood by reference to the preferred embodiment illustrated in the drawings.

Figure 2:
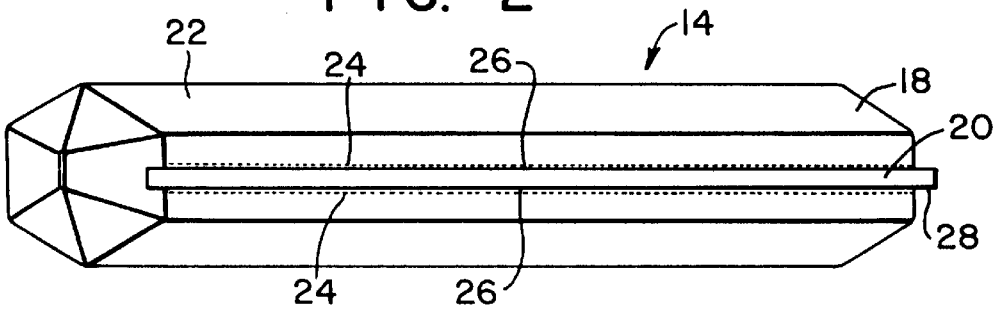
FIG. 2 shows an embodiment of a tied package of the present invention.

FIG. 1 shows a bundle 10 of shirred strands 12 to be incorporated into the package 14 by being encompassed by plastic film 18 as shown in FIG. 2. Such strands have longitudinal axes 16 and ends 17.

Tear strip 20 is secured to outside surface 22 of film 18. Weakened areas 24 in the form of perforations are provided in the film 18 along parallel edges 26 of tear strip 20. Tear strip 20 is unsecured to the film at one end to provide a pull tab 28 to easily grip and remove the tear strip. Preferably the strip extends at least the entire length of longitudinal axes 16.

Figure 3:
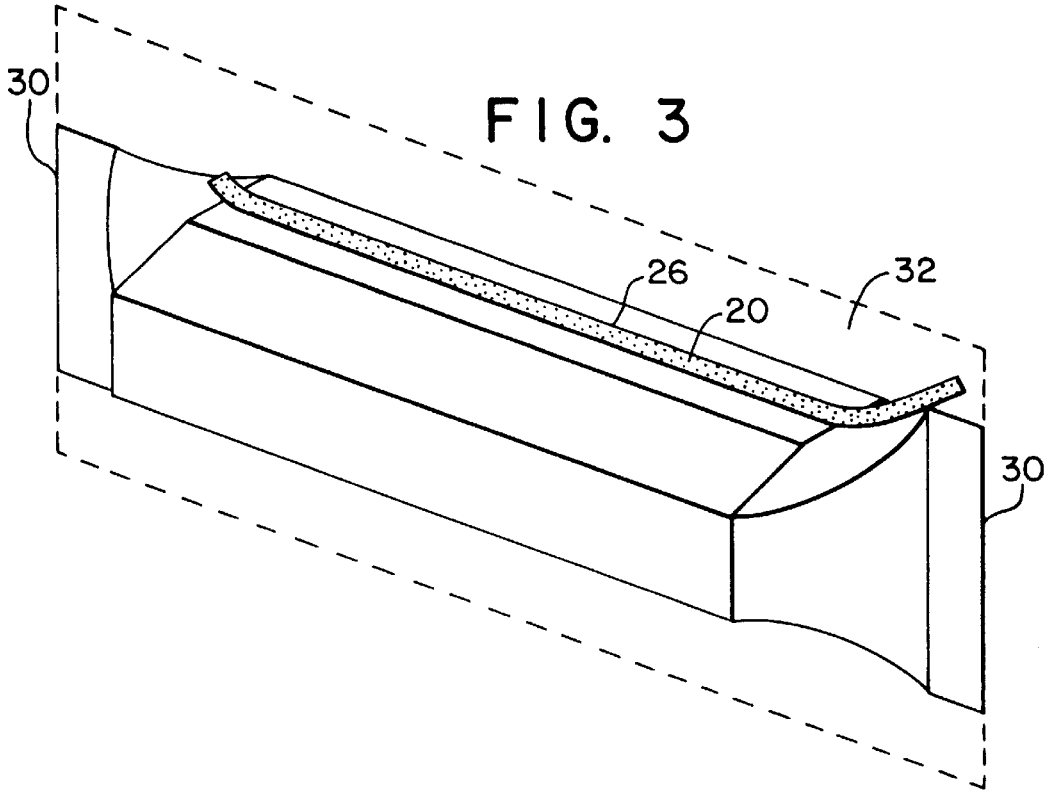
FIG. 3 shows a heat sealed embodiment of the invention.

In a preferred embodiment, as shown in FIG. 3, film 18 extends beyond ends 17 of the strands and is heat sealed.

In this embodiment, end heat seals 30 are provided which are in a plane 32 which is essentially parallel to an edge 26 of tear strip 20. Essentially parallel means within a 10° deviation from parallel and includes the embodiment where the plane contains the edge.

Surprisingly and unexpectedly, perforations 24, when of a small enough size, e.g., a 0.05 inch cut/0.25 inch tie, do not permit passage of significant moisture from strands in the package to the exterior environment.

What is claimed is:

1. A package comprising tubular food casing strands encased in a plastic film, said film encompassing said strands, said package being provided with a tear strip secured upon the outside surface of the film; weakened areas being provided in the film along parallel edges of said tear strip so that pulling of said strip away from the package causes film between the weakened areas to be removed with the strip thus opening the package and exposing the strands.

2. The package of claim 1 wherein said film is secured and sealed over the ends of the strands.

3. The package of claim 1 wherein the weakened areas along parallel edges of the said strip are spaced perforations.

4. The package of claim 2 wherein the weakened areas along parallel edges of the said strip are spaced perforations.

5. The package of claim 1 wherein an end portion of said tear strip is unsecured to said film to provide a pull tab.

6. The package of claim 2 wherein an end portion of said tear strip is unsecured to said film to provide a pull tab.

7. The package of claim 3 wherein an end portion of said tear strip is unsecured to said film to provide a pull tab.

8. The package of claim 4 wherein an end portion of said tear strip is unsecured to said film to provide a pull tab.

9. The package of claim 1 wherein said strip extends parallel to and along an entire length of longitudinal axes of said strands.

10. The package of claim 2 wherein said strip extends at least an entire length of the strands.

11. The package of claim 2 wherein seals over the ends of the strands are heat seals which are in a plane which is essentially parallel to a plane defined by an edge of a sealed portion of the tear strip.

* * * * *